US006920708B2

(12) United States Patent
Bates

(10) Patent No.: US 6,920,708 B2
(45) Date of Patent: Jul. 26, 2005

(54) EXCAVATING AND LOADING MACHINE

(75) Inventor: Richard Leslie Bates, Rugeley (GB)

(73) Assignee: J. C. Bamford Excavators Limited (GB)

( * ) Notice: Subject to any disclaimer, the term of this patent is extended or adjusted under 35 U.S.C. 154(b) by 0 days.

(21) Appl. No.: 10/673,601

(22) Filed: Sep. 29, 2003

(65) Prior Publication Data

US 2004/0128867 A1 Jul. 8, 2004

(30) Foreign Application Priority Data

Oct. 1, 2002 (GB) ..... 0222673

(51) Int. Cl.[7] ..... E02F 3/28; E02F 3/36
(52) U.S. Cl. ..... 37/443; 414/694
(58) Field of Search ..... 37/403–407, 466, 37/443, 444; 414/695, 695.5, 694, 685

(56) References Cited

U.S. PATENT DOCUMENTS

| | | | | |
|---|---|---|---|---|
| 4,941,786 A | * | 7/1990 | Steinbock | 414/695.7 |
| 5,606,809 A | * | 3/1997 | Allen | 37/443 |
| 5,618,156 A | * | 4/1997 | Brown | 414/694 |
| 5,964,567 A | | 10/1999 | Bamford | 414/685 |
| 6,071,066 A | | 6/2000 | Braud | 414/686 |

FOREIGN PATENT DOCUMENTS

| | | |
|---|---|---|
| EP | 0285281 A1 | 10/1988 |
| EP | 0 43211 A1 | 6/1991 |
| EP | 0577388 A2 | 1/1994 |
| EP | 0976878 | 2/2000 |
| GB | 2268155 A | 1/1994 |

* cited by examiner

*Primary Examiner*—Robert E Pezzuto
(74) *Attorney, Agent, or Firm*—MacMillan, Sobanski & Todd, LLC

(57) ABSTRACT

An excavating and loading machine has a body with a front end and a rear end, the body being carried on a steerable wheeled ground engaging structure, the machine including an excavating arm mounted at the rear end of the body, and a loading arm which is mounted on the body and extends forwardly of the body, and wherein an operator's cab is provided which is mounted towards the rear end of the body, generally centrally of the body between sides of the machine, and a machine engine is mounted beneath a bonnet structure towards the front end of the body generally centrally of the body between sides of the machine, and the loading arm is mounted towards one side of the machine and at least over a range of operating positions extends alongside the cab and bonnet structure.

10 Claims, 3 Drawing Sheets

EXCAVATING AND LOADING MACHINE

CROSS-REFERENCE TO RELATED APPLICATIONS

Priority is claimed to United Kingdom patent application Ser. No. 0222673.6 filed Oct. 1, 2002.

TECHNICAL FIELD

This invention relates to a wheeled excavating and loading machine.

BACKGROUND OF THE INVENTION

Excavating and loading machines are known which have a body with a loading arm at a front end of the body and an excavating arm at a rear end of the body, and a wheeled ground engaging structure, such as a pair of axles carrying ground engaging wheels.

Such machines are typically steerable by the wheels on one or both of the axles being steerable.

A combined excavating and loading machine provides for an owner, a versatile machine which is capable of performing a variety of excavating and loading operations. However, in providing a machine which is capable of performing both excavating and loading operations, design compromises have been made with the result that when the machine is performing particularly loading operations, machines have tended not to be as capable as modern dedicated loading machines, for one example of the kind in which a loading arm is mounted generally centrally of the machine between the sides of the machine with an operator's cab mounted towards one side of the machine, and a machine engine being mounted towards an opposite side of the machine, so that the loading arm can be lowered into a space between the cab and body structure beneath which the engine is at least partly provided.

BRIEF SUMMARY OF THE INVENTION

According to the invention we provide an excavating and loading machine having a body with a front end and a rear end, the body being carried on a steerable wheeled ground engaging structure, the machine including an excavating arm mounted at the rear end of the body, and a loading arm which is mounted on the body and extends forwardly of the body, and wherein an operator's cab is provided which is mounted towards the rear end of the body, generally centrally of the body between sides of the machine, and a machine engine is mounted beneath a bonnet structure towards the front end of the body generally centrally of the body between sides of the machine, and the loading arm is mounted towards one side of the machine and at least over a range of operating positions extends alongside the cab and bonnet structure.

Thus whereas in a conventional combined excavating and loading machine the loading arm is mounted for up and down movement about a generally horizontal axis which is towards a front of the cab, in the machine of the invention, because the loading arm extends alongside the cab, the loading arm may be mounted further rearwardly than with such machines, thus affording an operator many of the advantages of dedicated loader machines, such as improved sight lines over a larger range of loading arm movements, greater reach as the loading arm can be longer than can be provided on a conventional excavating and loading machine, and the machine can be better balanced during loading operations, particularly when handling loads at height.

Preferably the loading arm is mounted for up and down movement by one or more actuators, about a generally horizontal axis which is positioned towards a rear of the operator's cab, preferably directly above an axis about which rear wheels of the ground engaging structure rotate. Preferably the generally horizontal loading arm mounting axis is located above the rear wheels below, or at, or at least not substantially above, a plane containing an uppermost part of the bonnet structure.

The loading arm may include a plurality of relatively telescopic sections so that the arm may be capable of substantially longer reach than a loading arm provided on a conventional combined excavating and loading machine, and the arm may include a load handling tool support at an outermost end of the loading arm furthest from the body, which support may extend laterally with respect to the extent of the arm, in front of the bonnet structure. The load handling tool may typically be a loading bucket or other suitable loading tool which may be removable from the support to enable an alternative tool to be used.

Thus the loading tool may be generally central in front of the central bonnet structure for ease of operator use.

The excavating arm may be mounted at the rear end of the body on a carriage which permits the arm to be moved laterally across the rear of the body into an appropriate position for performing excavating operations, and the excavating arm may be mounted on a mounting which permits the arm to rotate about a generally upright axis and about a generally horizontal axis during excavating operations.

It will be appreciated 9 that notwithstanding the loading arm is preferably mounted towards the rear end of the body, the excavating and loading arms may be used independently, although not usually simultaneously, without any possibility of fouling.

The loading arm may be operated by first controls located at a first operating position in the operator's cab, and from which position the operator may drive the machine over the ground on the wheels, whilst the excavating arm may be controlled by second controls at a second operating position in the operator's cab, an operator's seat being moveable, e.g. rotatable to enable the operator to access and use either the first or second controls, depending upon the seat position.

DETAILED DESCRIPTION OF THE INVENTION

Figure 1:
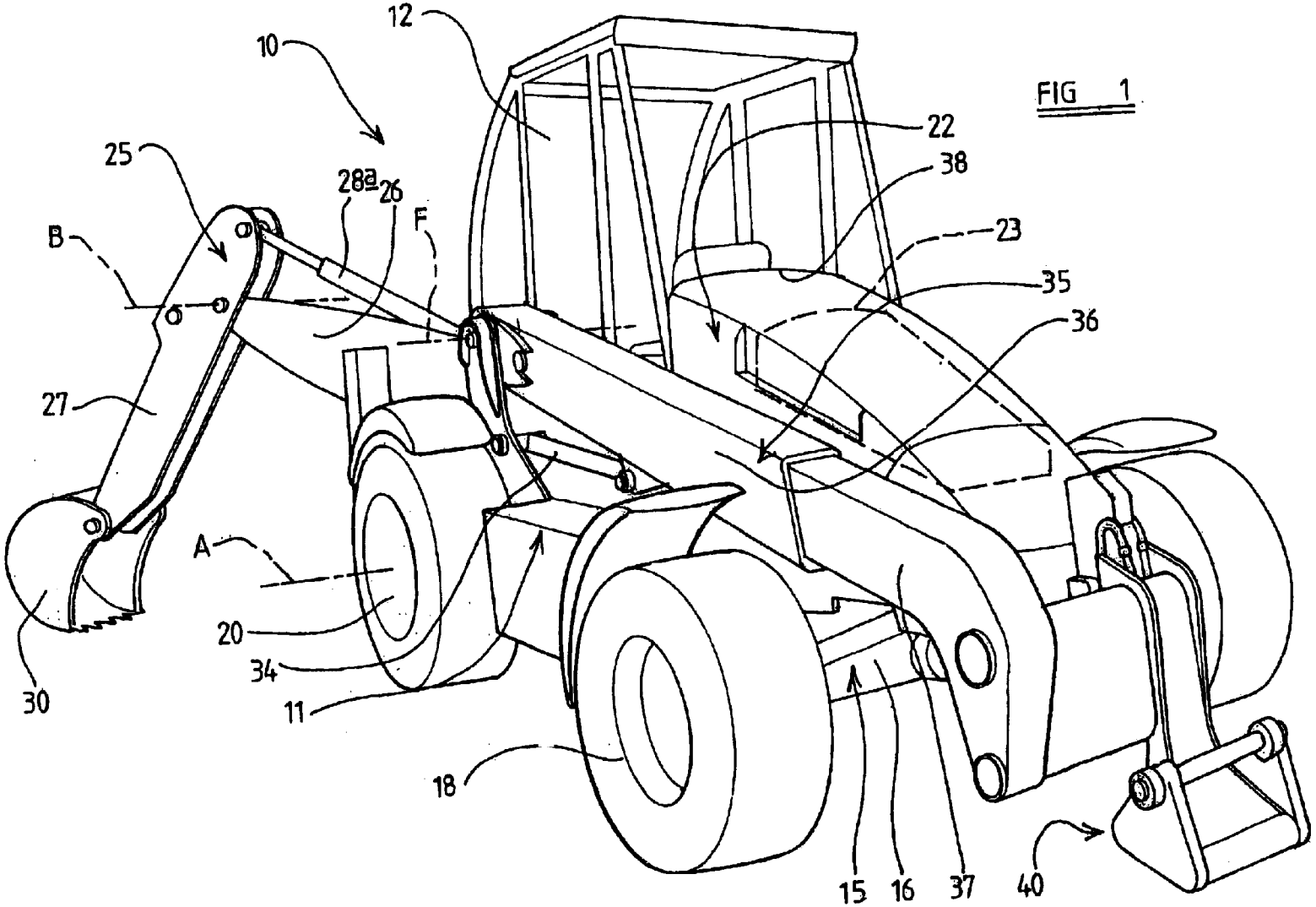
FIG. 1 is an illustrative perspective view from the front and one side of a machine in accordance with the invention.

Referring to the drawings there is shown a combined excavating and loading machine 10 which includes a body 11 on which there is provided an operator's cab 12. The cab 12 is positioned rearwardly of the body 11, generally centrally between sides of the machine 10, but slightly offset.

The body 11 is carried on a wheeled ground engaging structure 15 which in this example is provided by a front axle 16 which carries a pair of front wheels 18, and rear axle (not seen) which carries a pair of rear wheels 20. The rear wheels 20 are rotatable about an axis A of rotation, which axis will be further referred to below.

In front of the operator's cab 12, and extending to the front end of the body 11, there is a bonnet structure 22 beneath which there is provided a machine engine 23. The engine 23 is thus mounted generally centrally between the sides of the machine 10.

At the rear end of the body, there is provided an excavating arm 25 which includes a first section 26 which is mounted on the body 11 via a mounting 28, and a second part 27 which is pivotal about a generally horizontal axis B relative to the first part 26, by one or more actuators 28*a*. At the lowermost end of the second excavating arm part 27, 9 an excavating tool, such as an excavating bucket 30 is provided which too, is operated by one or more actuators (not shown).

The mounting 28 enables the excavating arm 25 to rotate about a generally upright axis C as well as about a generally horizontal axis D relative to the body 11 during excavating operations.

The mounting 28 is provided on a carriage 29 which is movable along a rail 32 provided at the rear of the body 11, either manually and/or by power means, to enable the excavating arm 25 to be moved to a position suitable for performing particular excavating operations.

The machine 10 further includes a loading arm 35 which in this example includes two relatively telescopic sections 36, 37. The arm 35, at least over a range of operating positions, extends alongside the cab 12 and the bonnet structure 22.

A first of the sections, section 36 is pivotally mounted on the body 11 for up and down movement of the arm 35 by one or more actuators 34, about a generally horizontal axis F, which axis F is located rearwardly of the body 11, adjacent a rear of the cab 22, and above the rear wheels 20. Preferably the mounting axis F is directly above the axis of rotation A of the rear wheels 20 but is below, or at, or at least not substantially above the level of an uppermost part 38 of the bonnet structure 22.

The loading arm 35 may thus, at least over a range of movements be raised and lowered alongside the cab 12 and bonnet structure 22 affording excellent visibility to an operator in the cab 12. Moreover, at an end of the loading arm 35 furthest from the body 11, there is provided a support structure 40 for a loading tool such as a bucket or loading forks or the like, the support structure 40 extending laterally of the remainder of the loading arm 22 in front of the bonnet structure 22, so that the loading tool may be located in use, directly centrally in front of the bonnet structure 22, so as to be centered on a center line of the machine 10.

The described mounting of the loading arm 35 provides the machine 10 with great stability even when handling heavy loads at height when the arm 35 may not be alongside the bonnet structure 22, and by providing the cab 12 towards a rear of the machine 10, an operator may enjoy excellent visibility when performing loading operations.

Figure 2:
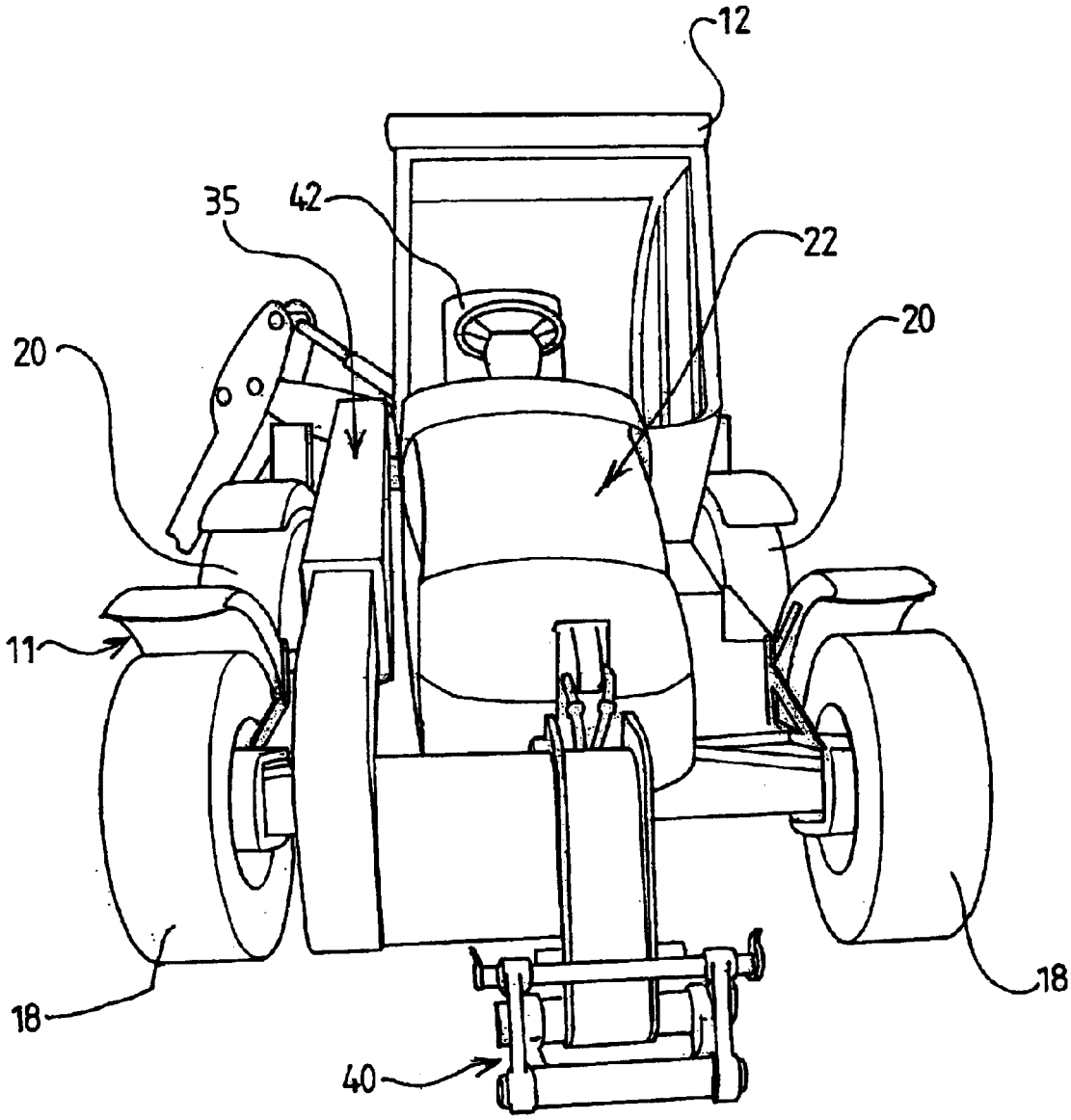
FIG. 2 is an illustrative view from the front of the machine of FIG. 1.
Figure 3:
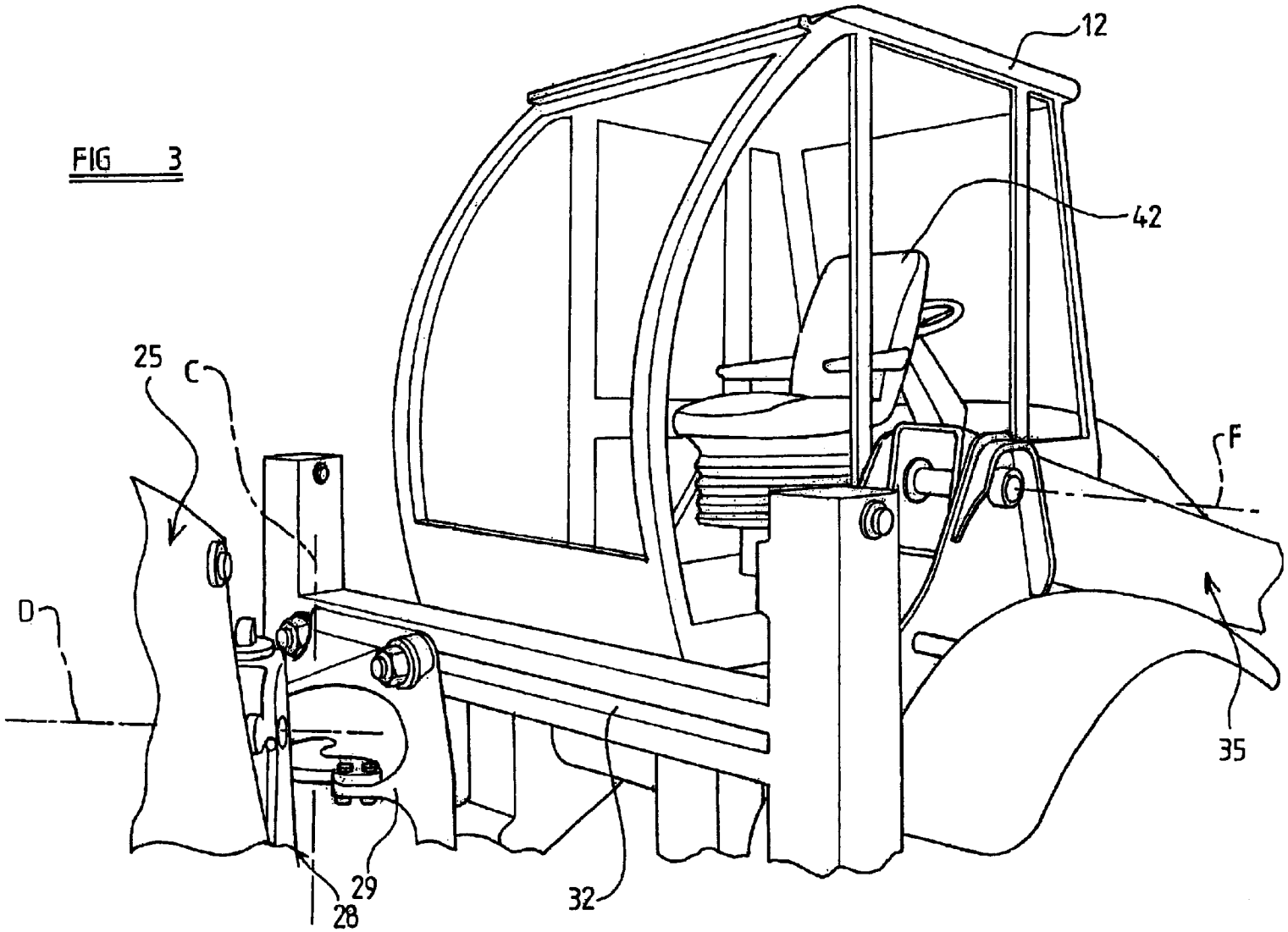
FIG. 3 is an illustrative perspective view of part of the machine of FIGS. 1 and 2 from the rear and one side.

Within the cab 12 there is provided an operator's seat 42 which is moveable, e.g. rotatable about a generally upright axis, to enable an operator to access first controls at a first operating position in the cab 12, when the seat 42 is facing forwardly (as shown in FIG. 2), to control the loading arm 35 and to drive the machine 10 over the ground, and alternatively to access and use second controls at a second operating position in the cab 12 with the seat 42 facing rearwardly, to control the excavating arm 2 during excavating operations, as seen in FIG. 3.

Further features of the machine 10 are as follows.

Desirably at least the front wheels 18 are steerable on their axle 15 although the rear wheels 20 may be steerable instead of or in addition to the front wheels 18.

The cab 12 configuration may be different to that shown, although the configuration shown does provide a compact cab 12 with good all round visibility in which an operator may comfortably work controlling the machine in both excavating and loading operations.

The bonnet structure 22 need not be of the exact configuration shown, although providing a bonnet structure 22 which dips down towards the front end of the machine 10 enables an operator when working the loading arm 35, to have sight line to the loading tool even when the loading arm 35 is in its lowest position, whilst the operator is sufficiently high in the cab 12 alternatively to have a good sight line to the outermost end of the excavating arm 25 during excavating operations.

The width of the machine 10 between the sides of the machine 10 can be designed to be within acceptable limits as there is no engine or engine covering structure e.g. bonnet at the opposite side of the loading arm 35 to the cab 12 as there is with some dedicated loading machines, and the loading arm 35 may be mounted at a relatively low position as the engine is not located beneath the arm 35 as is the case with other dedicated loading machines. Other dedicated loading machines have a rearwardly mounted engine, which although this affords great design flexibility in the location of the loading arm, such position is unavailable with the combined excavating and loading machine of the invention, due to the presence of the excavating arm 25.

Various modifications may be made without departing from the scope of the invention.

What is claimed is:

1. An excavating and loading machine having a body with a front end and a rear end, the body being carried on a steerable wheeled ground engaging structure, the machine including an excavating arm mounted at the rear end of the body, and a loading arm mounted on the body and extends forwardly of the body, an operator's cab mounted towards the rear end of the body, generally centrally of the body between sides of the machine, an engine mounted beneath a bonnet structure towards the front end of the body generally centrally of the body between sides of the machine, and wherein the loading arm is mounted towards one side of the machine and at least over a range of operating positions extends alongside the cab and bonnet structure.

2. A machine according to claim 1 wherein the loading arm is mounted for up and down movement by one or more actuators, about a generally horizontal axis which is located towards a rear of the operator's cab.

3. A machine according to claim 2 wherein the loading arm is mounted directly above an axis about which rear wheels of the ground engaging structure rotate.

4. A machine according to claim 2 wherein the generally horizontal loading arm mounting axis is located above the rear wheels not substantially above, a plane containing an uppermost part of the bonnet structure.

5. A machine according to claim 1 wherein the loading arm includes a plurality of relatively telescopic sections and a load handling tool support at an end of the loading arm furthest from the body, the support extending laterally with respect to the extent of the arm, in front of the bonnet structure.

6. A machine according to claim 5 wherein the load handling tool is a loading tool which is removable from the support to enable an alternative tool to be used.

7. A machine according to claim 5 wherein the loading tool in use, is located generally central in front of the central bonnet structure.

8. A machine according to claim 1 wherein the excavating arm is mounted at the rear end of the body on a carriage which permits the arm to be moved laterally across the rear of the body into an appropriate position for performing excavating operations.

9. A machine according to claim 1 in which the excavating arm is mounted to rotate about a generally upright axis and about a generally horizontal axis during excavating operations.

10. A machine according to claim 1 wherein the loading arm is operated by first controls located at a first operating position in the operator's cab, and from which position the operator may drive the machine over the ground on the wheels, whilst the excavating arm is controlled by second controls at a second operating position in the operator's cab, an operator's seat being moveable to enable the operator to access and use either the first or second controls, depending upon the seat position.

* * * * *